United States Patent [19]

Arimura et al.

[11] Patent Number: 4,467,770

[45] Date of Patent: Aug. 28, 1984

[54] METHOD AND APPARATUS FOR CONTROLLING THE AIR-FUEL RATIO IN AN INTERNAL COMBUSTION ENGINE

[75] Inventors: Takashi Arimura; Hisamitsu Yamazoe, both of Kariya; Toshimi Matsumura, Obu, all of Japan

[73] Assignee: Nippondenso Co., Ltd., Kariya, Japan

[21] Appl. No.: 405,578

[22] Filed: Aug. 5, 1982

[30] Foreign Application Priority Data

Aug. 10, 1981 [JP] Japan ..... 56-124152

[51] Int. Cl.[3] ..... F02M 51/00

[52] U.S. Cl. ..... 123/489

[58] Field of Search ..... 123/440, 489

[56] References Cited

U.S. PATENT DOCUMENTS 4,130,095 12/1978 Bowler et al. ..... 123/440

4,224,910 9/1980 O'Brien ..... 123/489 X 4,235,204 11/1980 Rice ..... 123/489 X

*Primary Examiner*—Tony M. Argenbright

*Attorney, Agent, or Firm*—Cushman, Darby & Cushman

[57] ABSTRACT

In an internal combustion engine, a basic fuel injection pulse width is calculated by parameters such as the engine speed and the intake-air quantity. The basic pulse width is compensated for by an integration compensation factor and a learning correction factor so as to obtain a desired air-fuel ratio. A predetermined number of integration compensation factors are sampled at every air-fuel ratio transition, and the mean value thereof is calculated. The learning compensation factor is corrected in accordance with the mean value of the predetermined number of integration compensation factors.

8 Claims, 9 Drawing Figures

20
18
17
106
POWER SUPPLY CIRCUIT
105
POWER SUPPLY CIRCUIT
107
RAM
108
ROM
100
CPU
111
TIMER
102
INTERRUPT CONTROL CIRCUIT
101
RPM COUNTER
15
RPM SENSOR

| Q \ N | 1 | 2 | 3 | -------- | n | ------- |
|---|---|---|---|---|---|---|
| 1 | $K_{11}$ | $K_{12}$ | $K_{13}$ | | ⋮ | |
| 2 | $K_{21}$ | $K_{22}$ | $K_{23}$ | | ⋮ | |
| 3 | $K_{31}$ | $K_{32}$ | $K_{33}$ | | ⋮ | |
| ⋮ | | | | | | |
| m | --- | --- | --- | --- | $K_{mn}$ | ------- |
| ⋮ | | | | | | |

METHOD AND APPARATUS FOR CONTROLLING THE AIR-FUEL RATIO IN AN INTERNAL COMBUSTION ENGINE

BACKGROUND OF THE INVENTION

1. Field of the Invention

The present invention relates to a method and an apparatus for feedback control of the air-fuel ratio of an air-fuel mixture at a desired value by means of an air-fuel ratio sensor positioned in the exhaust gas pipe in automobiles or the like.

2. Description of the Prior Art

A known feedback (closed-loop) control method for controlling the air-fuel ratio repeats the following steps so as to control the center value of the controlled air-fuel ratio within a very narrow range of air-fuel ratios around the stoichiometric ratio required for reducing and oxidizing catalysts. First, the running speed of the engine and the intake-air amount are detected. Then a basic fuel injection quantity supplied to fuel injection valves is calculated in accordance with the detected engine speed and the intake-air amount. The basic fuel injection quantity is corrected by using an air-fuel compensation factor (normal correction factor) which is calculated from detection signals indicative of the cooling water temperature, the intake-air temperature, and the like. Thus, the corrected fuel injection quantity determines the actual fuel-feeding rate of the engine.

The above-mentioned narrowly controlled center value of the air-fuel ratio is affected by the characteristics of the air-fuel ratio sensor, the exhaust gas composition characteristics, and the like. That is, the controlled center value of the air-fuel ratio often deviates from an optinum value as a result of the individual differences in the control characteristics of the parts of the engine due to aging of the engine or due to environmental changes.

In order to compensate for the individual differences in the parts of the engine, another air-fuel compensation factor which is called a learning correction factor is introduced to maintain an optinum air-fuel ratio. In this case, the basic fuel injection quantity is corrected by using two kinds of air-fuel compensation factors.

The learning correction factors (second air-fuel compensation factors) are also determined by the operating conditions of the engine, such as the engine speed and the intake-air quantity. In addition, the learning correction factors themselves are corrected by a detection signal from the air-fuel ratio sensor.

In the prior art, however, such correction of the learning correction factors is performed at every predetermined crank angle of the engine so that variance of the learning correction factors becomes large due to variance of the engine speed, with the result that the air-fuel ratio is not accurately controlled. In addition, even when the engine is in a transient operating condition, such as an accelerating or decelerating condition, correction of the learning correction factors is performed so that the air-fuel ratio after being controlled often deviates from an optimum value. As a result, when the feedback loop is opened, that is, when the feedback operation is stopped, the stoichiometric air-fuel ratio cannot be controlled so as to deteriorate the emission characteristics of the engine, the malfunctional initiation of the engine, and the like.

Note that the above-mentioned basic fuel injection quantity and two kinds of air-fuel compensation factors, that is, normal correction factors, integration (proportion) correction factors, and learning correction factors, are usually stored in a memory.

SUMMARY OF THE INVENTION

With a view to overcoming the foregoing problems, it is an object of the present invention to provide a method and an apparatus for feedback control of the air-fuel ratio in an internal combustion engine in which variance of the learning correction factors is reduced, with the result that the air-fuel ratio is very accurately controlled.

In accordance with the present invention, a plurality of integration correction factors are collected, for example, at every air-fuel ratio transition from the rich side to the lean side or vice versa. When the number of collected integration correction factors reaches a predetermined value, the mean value thereof is calculated, and, in addition, a amount is added to or subtracted from the learning factor in accordance with the calculated mean value. That is, the learning factors are corrected in accordance with the mean value of the integration correction factors. Thus, the learning correction factors can be precisely determined regardless of the engine speed.

The present invention will be more clearly understood from the following description with reference to the accompanying drawings.

DESCRIPTION OF THE PREFERRED EMBODIMENT

Figure 1:
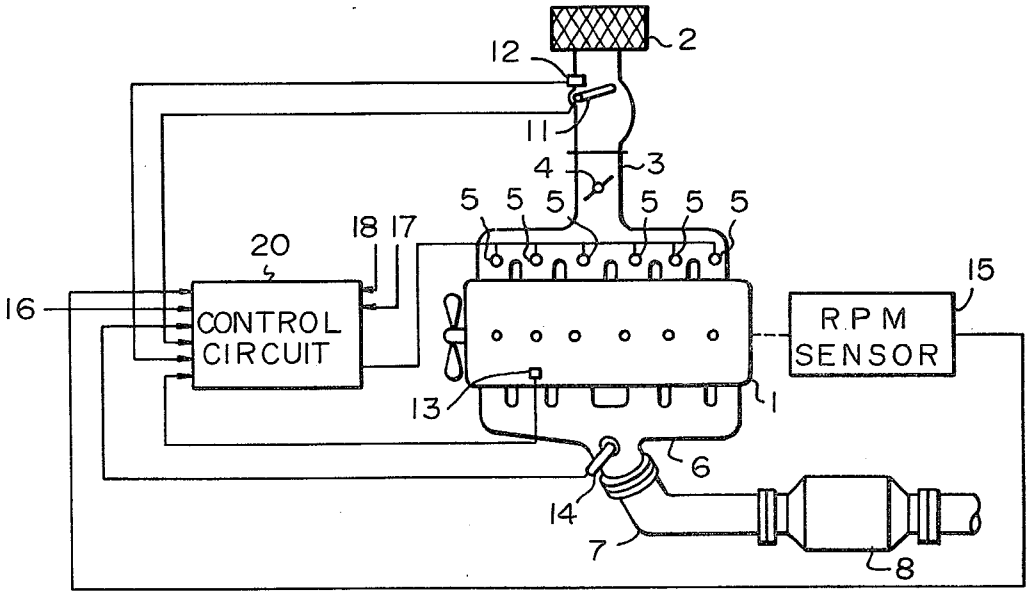
FIG. 1 is a schematic diagram illustrating the construction of an apparatus for performing the method of the present invention.

In FIG. 1, reference numeral 1 designates a known four-cycle spark ignition engine mounted on an automotive vehicle. The combustion gas is sucked into engine 1 by way of air cleaner 2, intake pipe 3, and throttle valve 4. The fuel is supplied to engine 1 from the fuel system (not shown) through electromagnetic fuel injectors 5 located in the respective cylinders. The exhaust gas produced after combustion is discharged into the atmosphere through exhaust manifold 6, exhaust pipe 7, three-way catalytic converter 8. Disposed in intake pipe 3 are potentiometer-type air-flow sensor 11 for detecting the amount of air sucked into engine 1 to generate an analog voltage corresponding to the amount of air flow and thermistor-type intake-air temperature sensor 12 for detecting the temperature of the air drawn into engine 1 to generate an analog voltage corresponding to the intake-air temperature. Disposed in engine 1 is thermistor-type water temperature sensor 13 for detecting the engine cooling-water temperature to generate an analog voltage corresponding to the cooling water temperature. Disposed in exhaust manifold 6 is air-fuel ratio sensor 14 for detecting the air-fuel ratio from the concentration of oxygen in the exhaust gas. Air-fuel ratio sensor 14 generates a high-level voltage (about 1 volt) when the air-fuel ratio in the exhaust gas is smaller than the stoichiometric air-fuel ratio (the rich side) and generates a low-level voltage (about 0.1 volts) when the air-fuel ratio in the exhaust gas is greater than the stoichiometric air-fuel ratio (the lean side). Reference numeral 15 designates an engine speed (rpm) sensor for detecting the rotational speed of the crankshaft (not shown) of engine 1 to generate a pulse signal having a frequency corresponding to the rotational speed. Engine speed sensor 15 may be comprised, for example, of the ignition coil of the ignition system to use the ignition pulse signal from the primary winding of the ignition coil to determine the engine speed. Control circuit 20 respond to the detection signals from sensors 11 through 15 to compute the amount of fuel to be injected into fuel injectors 5. In this case, the fuel injection quantity is adjusted by controlling the duration of opening of injectors 5. Also, connected to control circuit 20 are starter switch 16, battery 17, and key switch 18.

Note that control circuit 20 may be comprised, for example, of a microcomputer.

Figures 2, 2A, 2B:
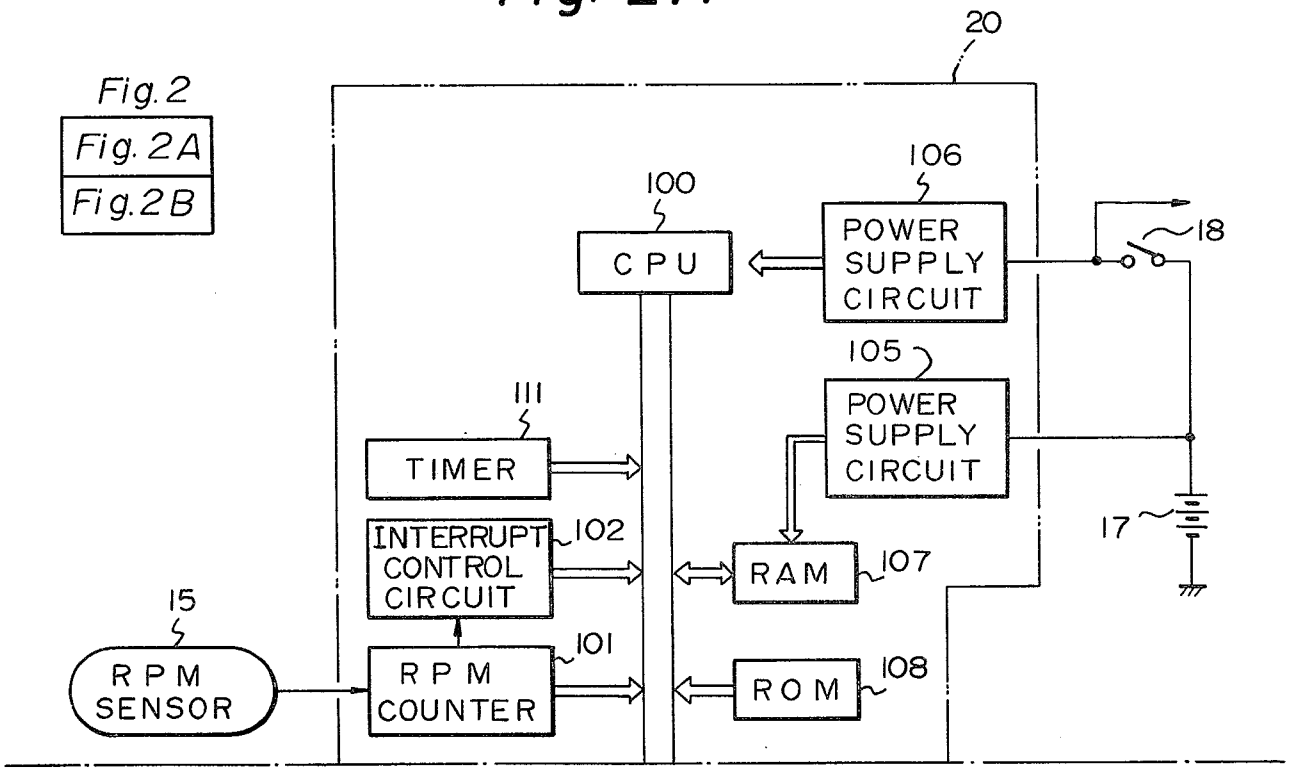
FIG. 2A–B are block circuit diagram of the control circuit of FIG. 1.
Figure 2B:
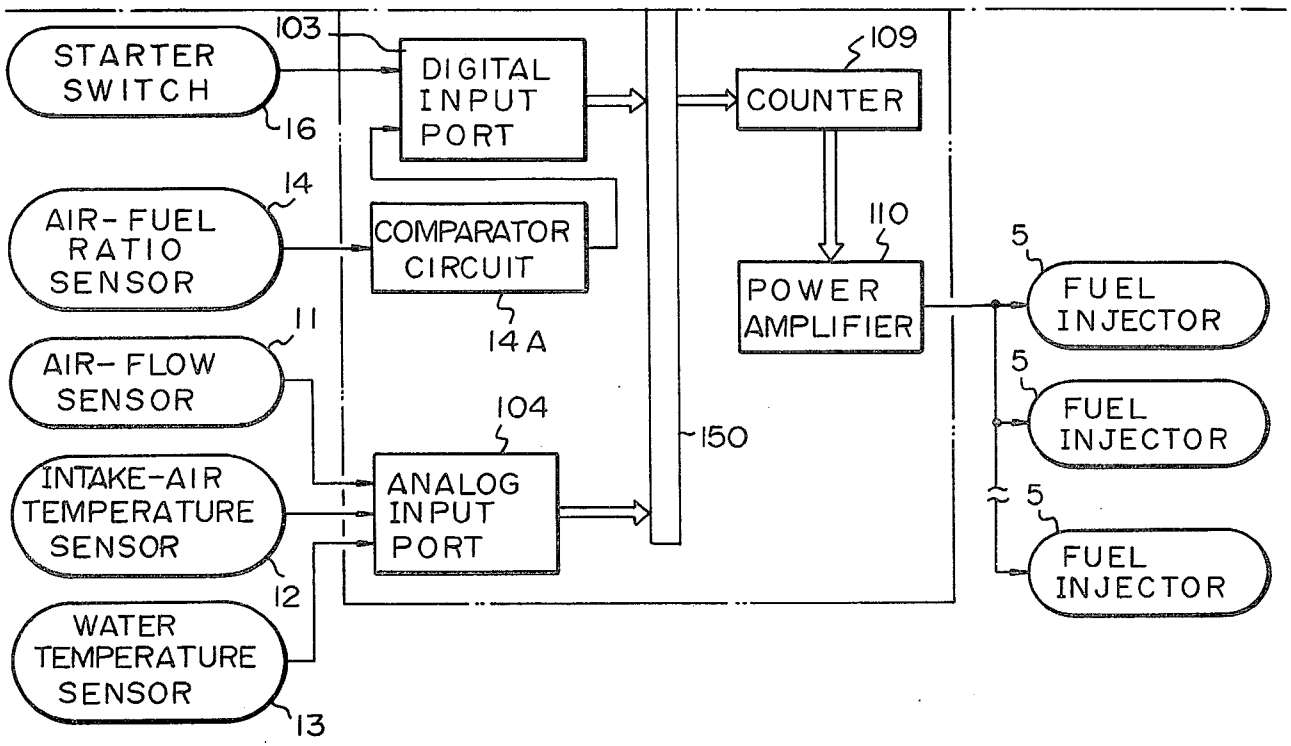

Control circuit 20 of FIG. 1 will be explained in more detail with reference to FIG. 2. In FIG. 2, reference numeral 100 designates a central processor unit (CPU) for computing the amount of fuel injected. Reference numeral 101 designates an RPM counter for detecting the signals from RPM sensor 15 and generating a digital signal representing the engine speed. In addition, RPM counter 101 supplies an interrupt command signal to interrupt control circuit 102 in synchronization with the rotation of the engine. Interrupt control circuit 102 respond to the supplied interrupt command signal to generate and supply an interrupt signal to CPU 100 through common bus 150. Reference numeral 103 designates a digital input port for transmitting to CPU 100 digital signals, including the output signal of comparator circuit 14A, for comparing the output signal of air-fuel ratio sensor 14 with a desired (stoichiometric) air-fuel ratio to determine whether the air-fuel ratio is great (lean) or small (rich) compared with the desired air-fuel ratio and the starter signal from starter switch 16 for turning on and off the starter (not shown). Reference numeral 104 designates an analog input port comprising an analog multiplexer and an A-D converter and having the function of subjecting the signals from air-flow sensor 11, intake-air temperature sensor 12, and cooling-water temperature sensor 13 to A-D conversion and successively transmitting the signals to CPU 100. The output signals from units 101, 102, 103, and 104 are transmitted to CPU 100 by way of common bus 150. Reference numeral 105 designates a power supply circuit for supplying the power to random-access memory (RAM) 107. Power supply circuit 105 is connected directly to battery 17 rather than through key switch 18 so that the power is always supplied to RAM 107 irrespective of the condition of key switch 18. Reference numeral 106 designates another power supply circuit connected to battery 17 through key switch 18. Power supply circuit 106 supplies the power to all the components except for RAM 107. RAM 107 is a temporary memory unit which is used temporarily when a program is being run. Since the power is always supplied to RAM 107 irrespective of the condition of key switch 18, as mentioned above, the stored contents are not erased even if key switch 18 is turned off so as to stop operation of the engine. Note that the learning correction factors $K_3$ which will be explained later are also stored in RAM 107. Reference numeral 108 designates a read-only memory (ROM) for storing programs, various kinds of constants, and the like. Reference numeral 109 designates a fuel-injection time-controlling counter comprising a register and a down counter for converting a digital signal indicative of the amount of fuel injected computed by CPU 100 to a pulse signal having a time width which determines the actual duration of opening of fuel injectors 5. Reference numeral 110 designates a power amplifier for actuating fuel injectors 5 and 111 a timer for measuring the time elapsed and supplying it to CPU 100.

RPM counter 101 respond to the output of RPM sensor 15 so that the engine speed is measured once for every revolution of the engine and an interrupt command signal is supplied to interrupt control circuit 102 at the end of each measurement. In response to the interrupt command signal, interrupt control circuit 102 generates an interrupt signal so as to cause CPU 100 to perform an interruption handling routine for computing the amount of fuel injected.

Figure 3:
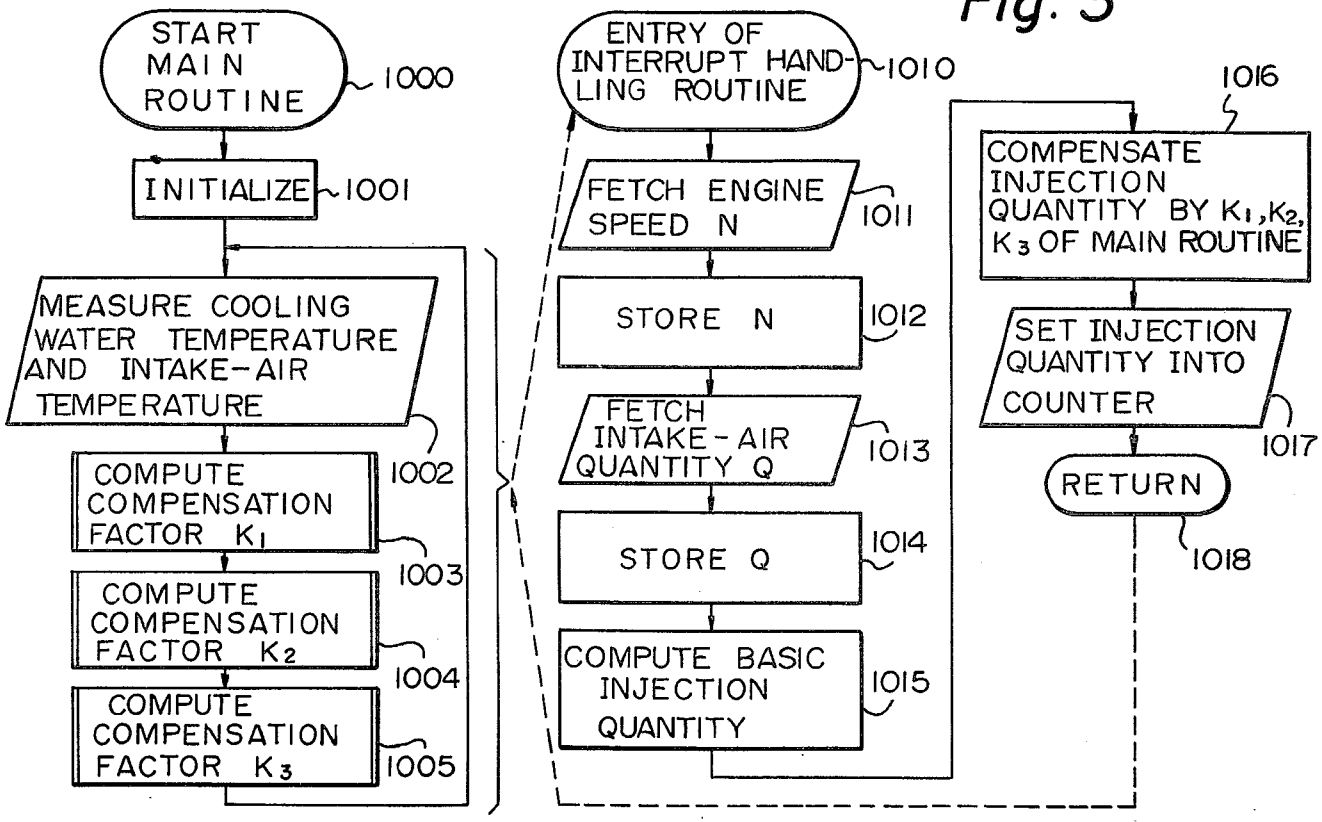
FIG. 3 is a simplified flow chart showing the operation of CPU of FIG. 2.

FIG. 3 is a simplified flow chart showing the operation of CPU 100 of FIG. 2. The function of CPU 100, as well as the overall operation of the circuit of FIG. 2, will now be explained with reference to the flow chart of FIG. 3. When key switch 18 and starter switch 16 are turned on so as to start the engine, the computational operation of the main routine is started by step 1000. Next, step 1001 performs an initializing routine to reset the contents of RAM 107 and set the constants to initial values. However, as will be explained later, note that such initialization is performed only after battery 17 has been removed. Next, step 1002 takes in the digital values indicative of the cooling water temperature and the intake-air temperature from analog input port 104 and stores the values in RAM 107. Step 1003 computes a first compensation factor (normal correction factor) $K_1$ from the result of step 1002 and stores the computed factor $K_1$ in RAM 107.

The above-mentioned first correction factor $K_1$ may be obtained, for instance, by selecting one value, in accordance with the coolant and intake air temperatures, from a plurality of values prestored in ROM 108 in the form of a map. If desired, however, the first correction factor $K_1$ may be obtained by solving a given formula with the above-mentioned data substituted.

In a following step 1004, the output signal of air-fuel ratio sensor 14 applied through comparator circuit 14A and input port 103 is read, and a second correction factor $K_2$, which will be described hereinlater, is either increased or decreased as a function of time measured by timer 111. The second correction factor $K_2$ indicates a result of integration and is stored in RAM 107.

A step 1005 follows step 1004. In step 1005, a third compensation factor $K_3$ (learning correction factor) is calculated by varying the same, and the result of the calculation will be stored in RAM 107. A detailed flowchart of step 1005 is shown in FIG. 5, and the operation of $K_3$ will be described with reference to FIG. 5.

Figure 4:
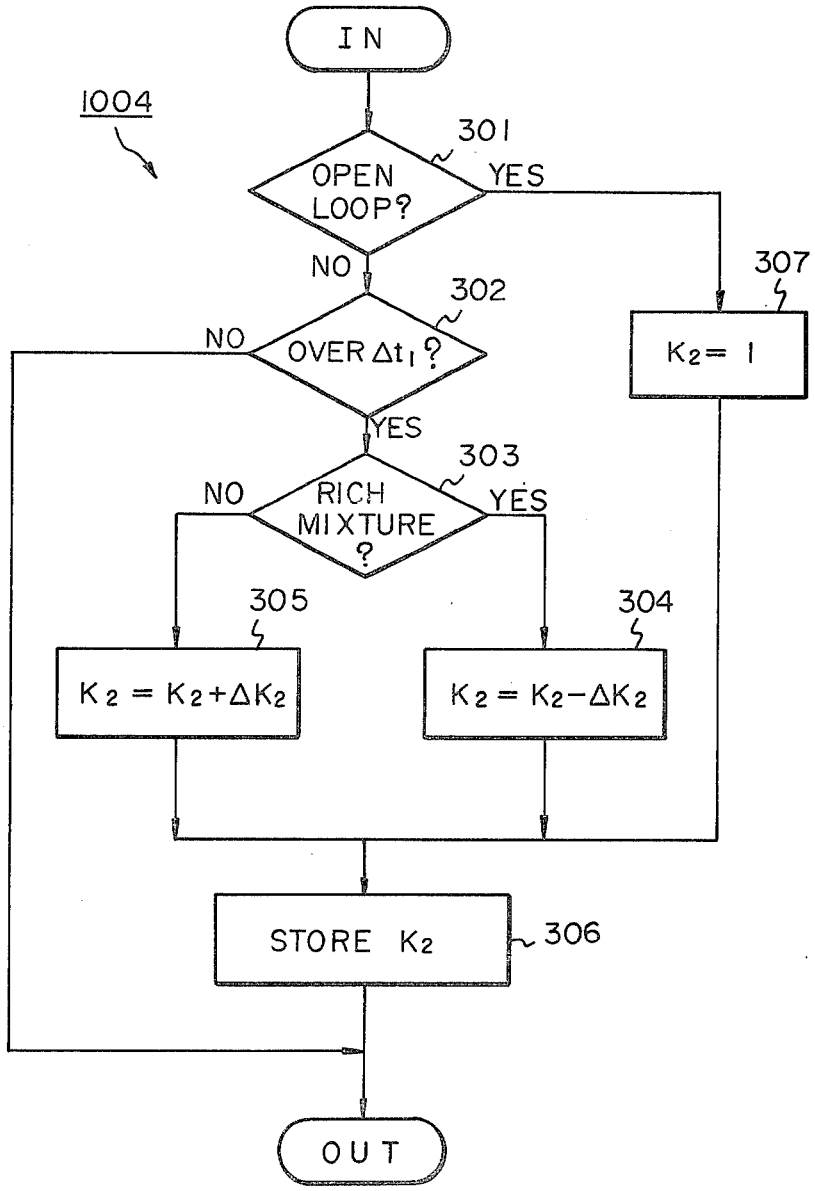
FIG. 4 is a detailed flow chart of step 1004 of FIG. 3.

FIG. 4 is a flowchart showing detailed steps included in step 1004 of FIG. 3, which steps are used to either increase or decrease, i.e. to integrate, the second correction factor $K_2$ (integration correcting amount). In step 301, it is detected whether the control system is in an open loop condition or in a closed loop condition. In order to detect such a state of the feedback control system, it is detected whether air-fuel ratio sensor 14 is active or not. This step 301, however, may be replaced with a step of detecting whether the coolant temperature or the like is above a given level to be able to perform a feedback control. When a feedback control cannot be performed, i.e. when the feedback control system is in an open loop condition, a following step 307 takes place to set as $K_2=1$, then entering into following step 306.

On the other hand, when a feedback control can be performed, step 302 takes place to detect whether the lapse of time measured has exceeded unit time $\Delta t_1$. If the answer of the step 302 is NO, the operation of step 1004 terminates. If the answer of this step 302 is YES, i.e. when the measured lapse of time has exceeded the unit time $\Delta t_1$, following step 303 takes place to see whether the output signal of air-fuel ratio sensor 14 indicates that the air-fuel mixture is rich or not. Assuming that a high level output signal of air-fuel ratio sensor 14 indicates a rich mixture, when such a high level output signal is detected, the program enters into step 304 in which the value of $K_2$, which has been obtained in the prior cycle, is reduced by $\Delta K_2$. On the contrary, when the air-fuel mixture is detected to be lean, namely when the output signal of air-fuel ratio sensor 14 is low, step 305 takes place to increase the value of $K_2$ by $\Delta K_2$. After the value of $K_2$ is either increased or decreased as mentioned in the above, the aforementioned step 306 takes place to store the renewed value of $K_2$ into RAM 107.

Figure 5:
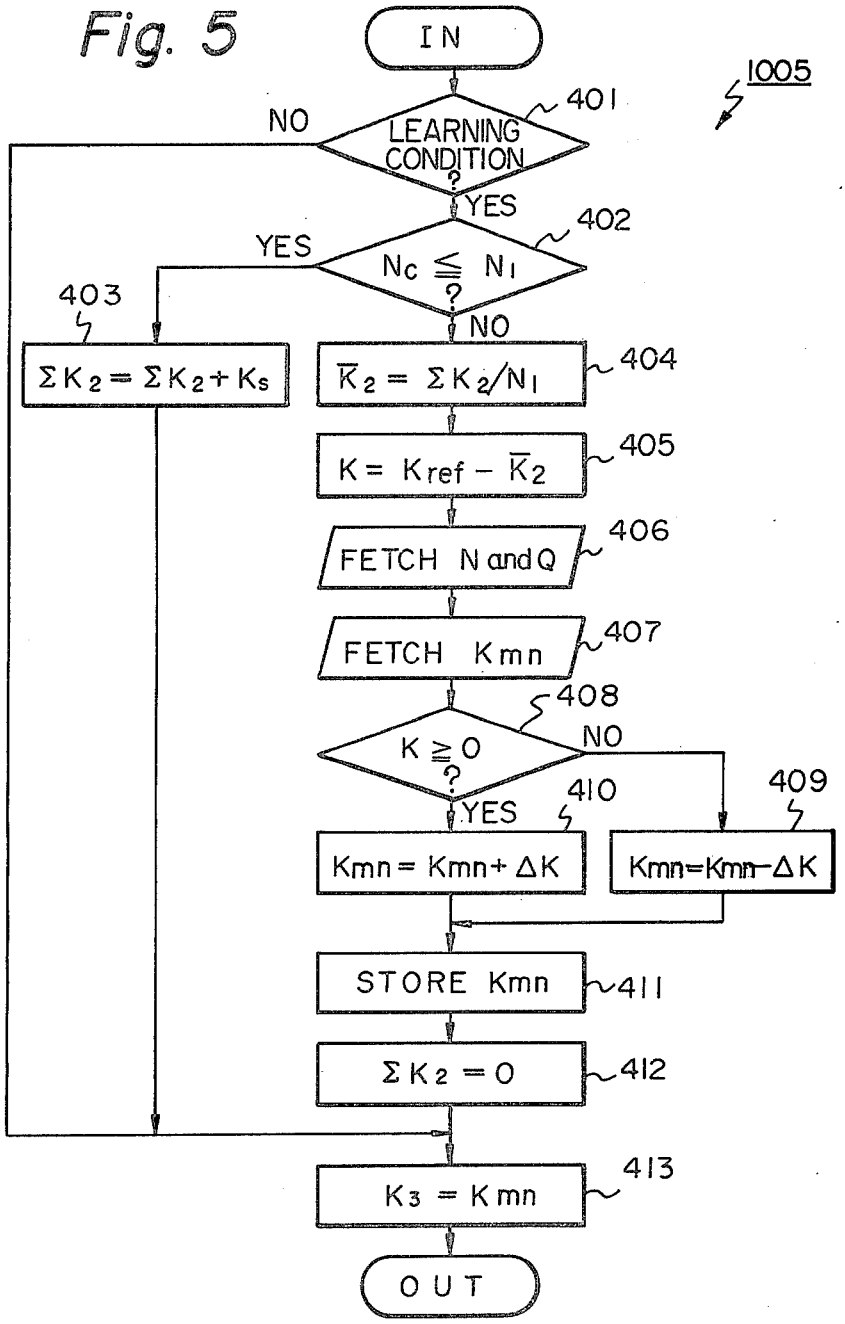
FIG. 5 is a detailed flow chart of step 1005 of FIG. 3.

FIG. 5 is a detailed flow chart of step 1005 of FIG. 3 which computes the second compensation factor $K_3$. Here, assume that constants $K_2$, $\Sigma K_2$, and Nc are set to the following initial values by initializing step 1001 of FIG. 3:

$K_2=1$ $\Sigma K_2=0$ $N_c=1$

First, step 401 determines whether or not the learning conditions are satisfied. That is, step 401 determines whether air-fuel ratio sensor 14 is in an activated state or whether the fuel is being increased according to the cooling water temperature and the like. That is, step 401 determines whether the control is in the closed-loop or in the open-loop. In addition, step 401 determines whether the engine is in a transient operating condition such as an accelerating condition or a decelerating condition, that is, whether the engine is in a steady operating condition. Note that such a steady condition is determined by the rate of change with time of the air flow to the engine. In addition, the learning conditions are not limited to the above-mentioned closed-loop condition or steady operating condition.

If the learning conditions are satisfied, control is transferred to step 402 which determines whether number $N_c$ of changes the air-fuel ratio from the rich side to the lean side or vice versa is smaller than predetermined value $N_1$. If the determination at step 402 is YES, control is transferred to step 403 in which integration processing is performed. Contrary to this, if the determination at step 402 is NO, control is transferred to step 404 in which mean value calculation processing is performed.

At step 403, value $K_s$ sampled at the time of transition from the rich side to the lean side or vice versa, which value will be later explained, is added to variable $\Sigma K_2$, that is, $\Sigma K_2=\Sigma K_2+K_s$, and then, control is transferred to step 408.

On the other hand, at step 404, integration value $\Sigma K_2$ is divided by sampling number $N_1$ to obtain mean value $\overline{K}_2$, that is, $\overline{K}_2=\Sigma K_2/N_1$. Next step 405 performs an operation for deviation K of mean value $K_2$ from controlled center value $K_{ref}$(which is, for example, 1), that is, $K=K_{ref}-\overline{K}_2$. Next step 406 takes in present engine speed N and intake-air amount Q and read learing value $K_{mn}$ out of a map or RAM 107 in accordance with N and Q.

Step 408 determines whether or not deviation K is larger than zero to modify learning value $K_{mn}$. If the determination at step 408 is YES, control is transferred to step 410 which add predetermined value $\Delta K$ to $K_{mn}$. On the contrary, if the determination at step 408 is NO, control is transferred to step 409 which substracts $\Delta K$ from $K_{mn}$.

Next step 411 stores corrected learning value $K_{mn}$ to the corresponding location of RAM 107. Then, step 412 performs the operation: $\Delta K_2=0$ and after that, step 413 allocates learning value to variable $K_3$. Thus, the operation of step 1005 terminates.

Note that, if the determination of step 401 is NO or after the operation of step 403 terminates, present engine speed N and intake-air amount Q are taken-in and, base upon such information learning value $K_{mn}$ is read out of RAM 107, which is, however, not explained in FIG. 4. After that, step 413 performs the operation $K_3=K_{mn}$ which is used for the correction calculation of fuel amount to be injected in an interrupt routine.

Figures 7, 8:
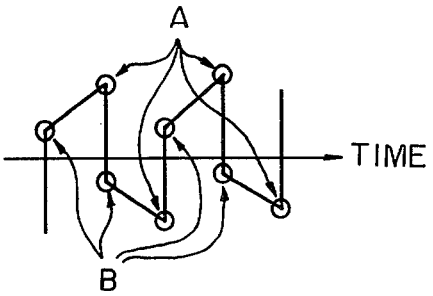
FIG. 7 is a diagram showing the contents of RAM 107 of FIG. 2.
FIG. 8 is a diagram showing the characteristics of proportional-integration control of the output signal of air-fuel sensor 14 of FIG. 2.

Note that the map of compensation factors $K_2$ of FIG. 7 is formed, for example, by dividing engine speed N at every 200 rpm and dividing intake-air quantity Q (from idle throttle to full throttle) into 32 blocks.

The skip (proportion) correction of integration value $K_2$ will be explained with reference to the flow chart of FIG. 6 which is a time interrupt routine performed at every 4 msec. First of all, step 501 determines whether or not the output of air-fuel ratio sensor 14 is reversed from the rich side to the lean side or vice versa. If the determination at step 501 is NO, control returns to the main routine. Contrary to this, if the determination at step 501 is YES, control is transferred to step 502.

Step 502 samples integration value $K_2$ at this moment and stores this value as variable $K_s$ which will be used in the calculation of the integration value at step 403 of FIG. 5.

Step 503 determines whether or not the air-fuel ratio is changed from the rich side to the lean side by detecting the change of the output of air-fuel ratio sensor 14. If the determination at step 503 is YES, control is transferred to step 504 which add definite skip value $\Delta K_s(>>\Delta K)$ to $K_2$. If the determination at step 503 is NO, that is, if the air-fuel ratio is changed from the lean side to the rich side, control is transferred to step 505 substract skip value $\Delta K_s$ from integration value $K_2$. Next step 506 stores renewed integration value $K_2$ into RAM 107.

Thus, as illustrated in the interrupt routine of FIG. 4, addition or substration is performed on integration value $K_2$ at every predetermined time period. This means that digital integration is performed on $K_2$, which is illustrated as slope wave form portions in FIG. 8. (Note that the slope waveform portions of FIG. 8 are actually stepwise, and therefore, these portions are macroscopically illustrated.) In addition, as illustrated in the routine of FIG. 6, skip value $K_s$ is added to or substracted from $K_2$ at transition points of the air-fuel ratio, to perform skip control (proportional control), which corresponds to the steep waveform portions from point A to point B or vice versa of FIG. 8.

Figure 6:
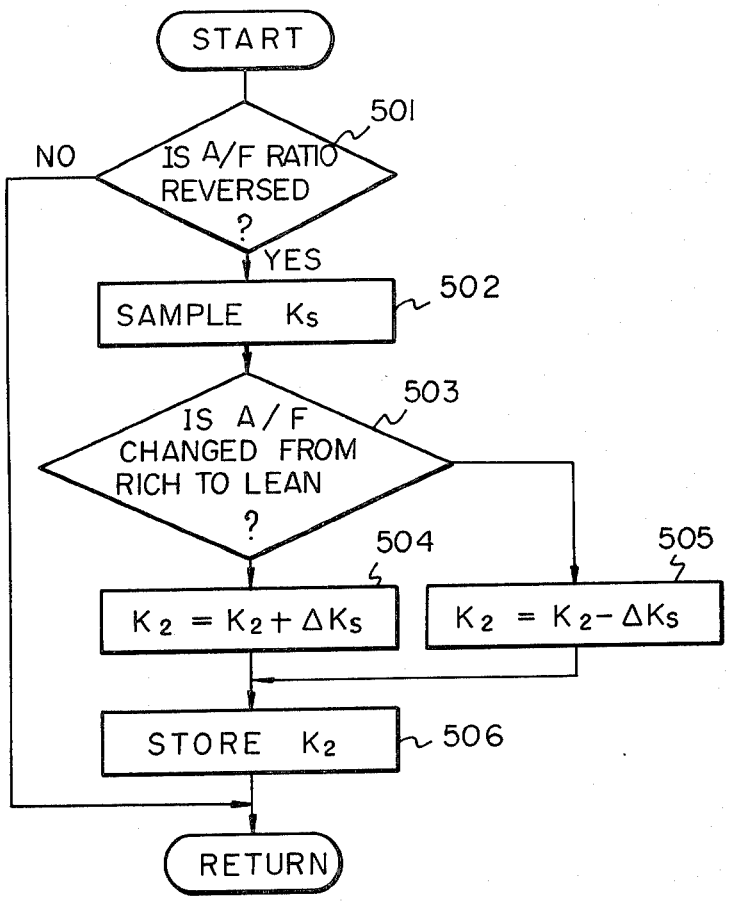
FIG. 6 is a detailed flow chart of a timer interrupt routine.

Therefore, the timing for sampling $K_2$ in the routine of FIG. 6 in order to obtain the mean value of $K_2$ is at a point (integration control completion point) immediately before a skip is applied to $K_2$. This point corresponds to point A of FIG. 8. However, it should be noted that, in FIG. 6, step 502 can also be performed before step 506, not before step 503. In this case, such a timing is at a point (proportional control completion point) immediately after a skip is applied to $K_2$, which point corresponds to point B of FIG. 8.

Thus, since a plurality of integration values $K_2$ are sampled and the mean value thereof is obtained to modify the learning value, it is vare that the learning value is modified in the wrong by the periodic fluctuation of the air-fuel ratio, so that precise learning control is performed.

Returning to FIG. 3, initialization step 1001 is explained. For example, battery 17 of FIG. 2 may occasionally be removed when a vehicle undergoes inspection or repair. In such a case, the constants, including compensation factors $K_3$ stored in RAM 107, may be destroyed or converted to insignificant values. Thus, a constant having a predetermined pattern is usually stored in a specified location of RAM 107 so as to determine whether battery 17 has been removed. When the program is started, step 1001 determines whether the value of the constant has been destroyed or converted. If the value is incorrect, it is considered that battery 17 has been removed, and, accordingly, the constants are reset. That is, all compensation factors $K_3(K_{mn})$ are set at "1", thus resulting the constant of the predetermined pattern. When the program is restarted, if the pattern constant has not been destroyed, the constants, including compensation factors stored in RAM 107, will not be initialized.

Normally, the processes of steps 1002 to 1005 in the main routine are repeatedly performed in accordance with the control program. When an interrupt signal for fuel injection quantity computation is supplied from interrupt control circuit 102 to CPU 100, even if the main routine is being performed, CPU 100 immediately interrupts the operation of the main routine and proceeds to the interrupt handling routine of step 1010. Step 1011 takes in the output signal of RPM counter 101 indicative of engine speed N which is stored in RAM 107 by step 1012. Next, step 1013 takes in from analog input port 104 the signal indicative of the amount of air flow or intake-air quantity Q which is stored in RAM 107 at step 1014. Engine speed N and intake-air quantity Q may be used as parameters to detect a normal condition in the computation of compensation factors $K_2$ and $K_3$ by steps 1004 and 1005 of the main routine. Next, step 1015 computes a basic fuel injection quantity, that is, the injection time-duration $\tau$ of opening fuel injectors 5, which is determined by engine speed N and intake-air quantity Q. The calculating formula is $\tau = F \times Q/N$, where F is constant. Next, step 1016 reads out of RAM 107 three kinds of compensation factors $K_1$, $K_2$ and $K_3$ computed by the main routine and then compensates the injection quantity (injection time-duration) which determines the air-fuel ratio. The calculating formula for this injection time-duration T is $T = \tau \times K_1 \times K_2 \times K_3$. Next, step 1017 sets the compensated fuel injection quantity data into counter 109. Then CPU 100 proceeds to step 1018 which returns control to the main routine. In this case, control is returned to the processing step which was interrupted by interrupt processing.

The function of CPU 100 has been explained briefly so far.

Thus, since a large number of compensation factors (learning correction factors) $K_3(=K_{mn})$ are prepared in RAM 107 in accordance with engine speed N and intake-air quantity Q, an optinum compensation factor responsive to the operating state of the engine can be immediately used, and, accordingly, a fast response control can be performed for all kinds of operating states, including the transient operating state. In addition, since compensation factors $K_3$ are modified in response to the operating state of the engine, the compensation factors $K_3$ are also automatically modified in response to the aging or deterioration of the engine and the individual parts thereof.

We claim:

1. A method for controlling the air-fuel ratio in an internal combustion engine comprising the steps of:

detecting the air-fuel ratio in the exhaust gas of said internal combustion engine;

detecting the operating condition of said internal combustion engine;

calculating a value which corresponds to a basic fuel-feeding amount of said internal combustion engine by using said operating condition;

calculating an integration compensation factor which corresponds to the deviation of the actual air-fuel ratio from a desired air-fuel ratio, depending upon said operating condition;

calculating a learning compensation factor depending upon said integration compensation factor and said operation condition;

compensating the calculated value related to the fuel-feeding amount by using said integration compensation factor and said learning compensation factor corresponding to said operating condition;

adjusting the actual fuel-feeding amount by using the compensated value related to the fuel-feeding amount;

repeating the above sequence of steps so as to control the actual air-fuel ratio in said internal combustion engine within a predetermined range;

averaging a predetermined number of said integration compensation factors; and correcting said learning compensation factor in accordance with the average value of the predetermined number of said integration compensation factors.

2. A method as set forth in claim 1, wherein said average step includes the steps of:

sampling integration compensation factors at every air-fuel ratio transition from the rich side to the lean side or vice versa;

integrating the sampled integration compensation factors;

determining whether the number of the sampled integration compensation factors reaches the predetermined value; and only when the number of the sampled integration compensation factors reaches the predetermined value, dividing the integrated compensation factors by the predetermined value.

3. A method as set forth in claim 1, wherein said correcting step includes the step of:

determing whether the average value of integration compensation factors is smaller than a predetermined value;

when the average value of integration compensation factors is smaller than the predetermined value, adding a definite value to said learning compensation factor depending upon said operating condition; and when the average value of integration compensation factors is larger than the predetermined value, subtracting the definite value from said learning compensation factor depending upon said operating condition.

4. A method for feedback control of the air-fuel ratio of an air-fuel mixture in an internal combustion engine at a desired value by means of an air-fuel ratio sensor postioned in the exhaust gas, comprising the step of:

performing proportional integration operation upon air-fuel ratios in accordance with the output signal of said air-fuel ratio sensor to calculate an proportional/integration compensation factor;

calculating and storing a learning compensation factor depending upon an operating state of said engine in accordance with said proportional/integration factor;

sampling a predetermined number of proportional-/integration compensation factors at every air-fuel ratio transition of said air-fuel sensor from the rich side to the lean side or vice versa;

averaging the predetermined number of proportional/integration compensation factors; and modifying said learning compensation factor depending upon an operating state of said engine in accordance with the average value of the predetermined number of proportional/integration compensation factors, the air-fuel ratio of said engine being fedback to a desired air-fuel ratio in accordance with the modified learning compensation factor.

5. An apparatus for controlling the air-fuel ratio in an internal combustion engine comprising:

means for detecting the air-fuel ratio in the exhaust gas of said internal combustion engine;

means for detecting the operating condition of said internal combustion engine;

a computer means for calculating a value which corresponds to a basic fuel-feeding amount of said internal combustion engine by using said operating condition, said computer means calculating an integration compensation factor which corresponds to the deviation of the actual air-fuel ratio from a desired air-fuel ratio, depending upon said operating condition, said computer means calculating a learning compensation factor depending upon said integration compensation factor and said operating condition, said computer means compensating the calculated value related to the fuel-feeding amount by using said integration compensation factor and said learning compensation factor corresponding to said operating condition;

means for adjusting the actual fuel-feeding amount by using the compensated value related to the fuel-feeding amount;

means for repeating the above sequence of steps so as to control the actual air-fuel ratio in said internal combustion engine within a predetermined range;

means for averaging a predetermined number of said integration compensation factors; and means for correcting said learning compensation factor in accordance with the average value of the predetermined number of said integration compensation factors.

6. Apparatus as set forth in claim 5, wherein said averaging means includes:

means for sampling integration compensation factors at every air-fuel ratio transition from the rich said to the lean side or vice versa;

means for integrating the sampled integration compensation factors;

means for determining whether the number of the sample integration compensation factors reaches the predetermined value; and means for dividing the integrated compensation factors by the predetermined value, only when the number of the sampled integration compensation factors reaches the predetermined value.

7. Apparatus as set forth in claim 6, wherein said correcting means includes:

means for determining whether the average value of integration compensation factors is smaller than a predetermined value;

means for adding a definite value to said learning compensation factor depending upon said operating condition, when the average value of integration compensation factors is smaller than the predetermined value; and means for subtracting the definite value from said learning compensation factor depending upon said operating condition, when the average value of integration compensation factors is larger than the predetermined

8. Apparatus for feedback control of the air-fuel ratio of an air-fuel mixture in an internal combustion engine at a desired value by means of an air-fuel ratio sensor positioned in the exhaust gas, comprising:

means for performing proportional integration operations upon air-fuel ratios in accordance with the output signal of said air-fuel ratio sensor to calculate a proportional/integration compensation factor;

means for calculating and storing a learning compensation factor depending upon an operating state of said engine in accordance with said proportional-/integration factor;

means for sampling a predetermined number of proportional/integration compensation factors at every air-fuel ratio transition of said air-fuel sensor from the rich side to the lean side or vice versa;

means for averaging the predetermined number of proportional/integration compensation factors; and means for modifying said learning compensation factor depending upon an operating state of said engine in accordance with the average value of the predetermined number of proportional/integration compensation factors, the air-fuel ratio of said engine being fedback to a desired air-fuel ratio in accordance with the modified learning compensation factor.

* * * * *